United States Patent [19]

Scheeren

[11] Patent Number: 4,573,632

[45] Date of Patent: Mar. 4, 1986

[54] FOOD CONTAINER

[76] Inventor: Jan-Mathieu Scheeren, Holset 38, 6295 NC Lemiers, Netherlands

[21] Appl. No.: 615,047

[22] Filed: May 29, 1984

[51] Int. Cl.[4] ..... B65D 1/34

[52] U.S. Cl. ..... 229/2.5 R; 206/318; 220/20

[58] Field of Search ..... 220/20; 229/2.5 R; 206/318

[56] References Cited

U.S. PATENT DOCUMENTS 3,084,791 4/1963 Hawley ..... 206/318
3,265,280 8/1966 Butzko ..... 229/2.5 R
3,303,964 2/1967 Luker ..... 229/2.5 R
3,530,917 9/1970 Donovan ..... 229/2.5 R

FOREIGN PATENT DOCUMENTS 2249177 4/1973 Fed. Rep. of Germany ..... 220/20

*Primary Examiner*—George E. Lowrance
*Attorney, Agent, or Firm*—Jones & Askew

[57] ABSTRACT

A food container made of thermoplastic material such as pvc. The food container has the shape of a pound cake tin, and also has a central cone with a closed top. The food container has an outer horizontal rim to which a tin flat lid is attached. The horizontal rim and the closed top of the central cone may have the same level, and the lid can be bound to the horizontal rim as well as to the top of the central cone.

2 Claims, 2 Drawing Figures

FOOD CONTAINER

BACKGROUND OF THE INVENTION

This invention concerns a food container made from thermoplastic pvc.

This kind of containers are known in many applications and serve, for example, to be filled with various foods for consumption. After being filled, the containers are transported and warehoused and then offered for sale.

The containers are typically closed by a lid of a Stanoil sheet which is attached closely to the package rim and can be torn off as for example for yoghurt cups; or by a clearview pvc, for example, for containers for snack products.

For solidity reasons the known containers are either very limited in their dimensions or can only be used to be filled with foods of a low specific gravitity.

Unforeseen deforming of the containers can lead to damage of the container walls or the container lid, so that there is no guarantee for adequate conservation of the contents.

SUMMARY OF THE INVENTION

The object of the invention is to create a food container which, even when exceeding the dimensions of common cup sizes, has still enough solidity to guarantee adequate conservation when filled with foods with a relatively high specific gravity as for example, ice cream and other foods ready for consumption.

Starting from a food container made from thermoplastic pvc, it is proposed to form the pvc plastic in the shape of a pound cake tin, whose rim is horizontally ring shaped around the outside of the container.

DETAILED DESCRIPTION OF PREFERRED EMBODIMENTS

Figure 1:
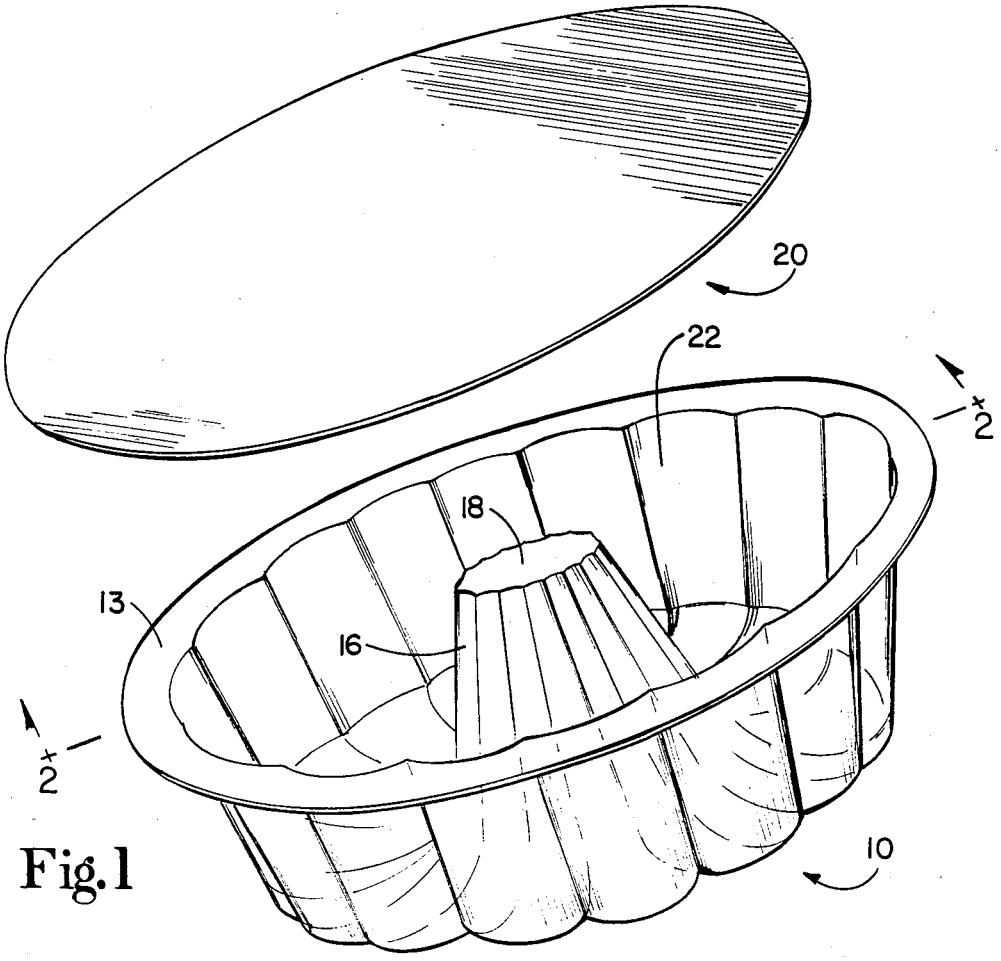
FIG. 1 is a pictorial view showing a container according to a preferred embodiment of the present invention, with the lid shown removed.
Figure 2:
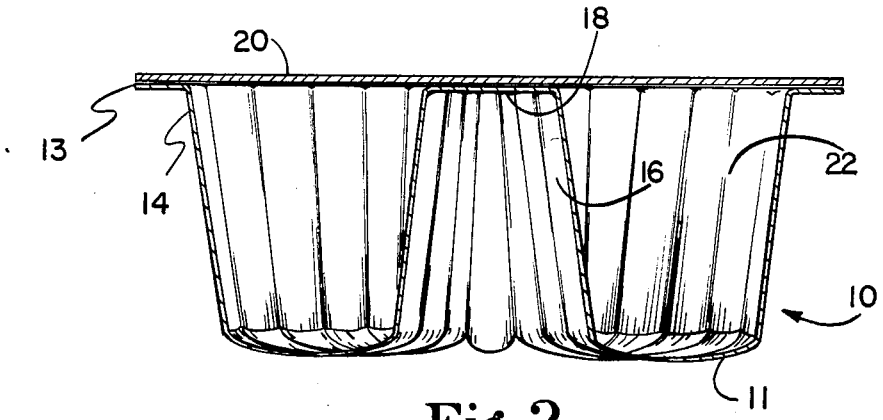
FIG. 2 is a vertical section view of the container shown in FIG. 1, with the lid attached to the container.

By forming the container 10 in the shape of a pound cake tin according to this invention, the good container obtains an excellent solidity of itself even when it is made from pvc plastic, which has a relatively low solidity. The container 10 formed in the shape of a pound cake tin not only obtains stability edges at the bottom 11 by the typical rounded shapes, but also has a surprising high solidity by the ring shape of the container, while at the level of the maximum weight the solidity is additionally increased by the outer rim 13 which is horizontally ring shaped around the outside 14 of the container.

After forming the container 10 as in the present invention, the pvc plastic is formed into a shape having a central cone 16 coming concentrically out of the form, whose top 18, unlike the common shapes of a pound cake tin, is closed.

By forming the present container like this, the risk is eliminated that the central cone coming concentrically out of the form is deformed to the inner or outer side of the cone as a result of the pressure of the container contents, because the closed top 18 of the central cone serves as a supporting member.

In one embodiment of the invention the top 18 of the central cone is at the same level as the outer horizontal rim 13, and a container lid 20 in the shape of a round slice can be bound to the outer horizontal rim as well as to the top of the central cone, while the hollow capacity 22 of the container obtains the shape of a circle.

As far as the solidity of the container 10 depending on the consistency of the container contents allows, there is the option to increase the volume of the container according to a further embodiment of the invention, wherein the top side 18 of the central cone is below the level of the outer horizontal rim 13. By this embodiment according to the invention, the volume of the container can be increased by shortening the central cone.

The food container according to this invention is particularly suitable to be filled with, for example, ice cream by which the container is closed as described by a lid in the shape of a round slice that is also made of plastic, pvc, or of another suitable material. The lid can be removably secured to the rim 13 by any suitable means such as adhesive bonding or the like. After having removed the lid of the container, the container can like a pound cake tin be turned over and removed, so that the contents as from a pound cake tin can be presented for consumption.

I claim:

1. A food container for receiving moldable foodstuffs conforming to the shape of the container, comprising a container body made of pliant thermoplastic PVC and having the shape of a pound-cake tin defining an open annular food-receiving channel disposed around a central region;

said container body having a bottom with an inner wall, and having an outer wall extending upwardly from the bottom to an outer edge surrounding said annular channel, said inner and outer walls tapering outwardly from the bottom so as to promote unitary release of a molded foodstuff received therein;

a rim joining said outer edge of the outer wall and extending horizontally out therefrom to surround the outer edge of the container body;

said inner wall defining a central truncated cone extending upwardly from said bottom of the container body;

said truncated cone having a closed top;

said top being horizontal and substantially coplanar with said horizontal rim surrounding the outer edge of the container body, so that the horizontal closed top of the central truncated cone is at the same level as the horizontal rim, whereby the solidity of the container is enhanced by the horizontal rim outside the container body and by the closed horizontal top of the central truncated cone.

2. The food container as in claim 1, further comprising:

a separate container lid removably secured to said container body at said horizontal rim to enclose said annular channel;

said lid having a flat bottom surface which rests on said horizontal rim and engages said horizontal top of the central truncated cone, so that the securement of the secured lid to the horizontal rim and the engagement thereof with the horizontal top of the truncated cone further strengthen the solidity of the food container when filled with a moldable foodstuff.

* * * * *